US011109461B2

(12) United States Patent
Hopwood et al.

(10) Patent No.: US 11,109,461 B2
(45) Date of Patent: Aug. 31, 2021

(54) LED LIGHTING APPARATUS CAPABLE OF COLOR TEMPERATURE CONTROL

(71) Applicant: Seoul Semiconductor Co., Ltd., Ansan-si (KR)

(72) Inventors: Keith Hopwood, Ansan-si (KR); Sung Ho Jin, Ansan-si (KR); Hyung Jin Lee, Ansan-si (KR); Sang Wook Han, Ansan-si (KR)

(73) Assignee: Seoul Semiconductor Co., Ltd., Ansan-si (KR)

( * ) Notice: Subject to any disclaimer, the term of this patent is extended or adjusted under 35 U.S.C. 154(b) by 0 days.

(21) Appl. No.: 16/890,271

(22) Filed: Jun. 2, 2020

(65) Prior Publication Data

US 2020/0337129 A1 Oct. 22, 2020

Related U.S. Application Data

(62) Division of application No. 16/044,515, filed on Jul. 25, 2018, now Pat. No. 10,791,597.

(Continued)

(51) Int. Cl.

*H05B 45/395* (2020.01)
*H05B 45/20* (2020.01)

(Continued)

(52) U.S. Cl.

CPC ..... *H05B 45/395* (2020.01); *F21V 23/04* (2013.01); *H05B 45/20* (2020.01); *H05B 45/44* (2020.01)

(58) Field of Classification Search

CPC ..... H05B 45/10; H05B 45/18; H05B 45/20; H05B 45/28; H05B 45/30; H05B 45/37;

(Continued)

(56) References Cited

U.S. PATENT DOCUMENTS 7,911,151 B2 3/2011 Xu
8,456,095 B2 6/2013 Huynh (Continued)

FOREIGN PATENT DOCUMENTS

CN 106658871 5/2017
DE 102010040266 9/2011

(Continued)

OTHER PUBLICATIONS

Notice of Allowance dated Apr. 8, 2020, in U.S. Appl. No. 16/044,515.

(Continued)

*Primary Examiner* — Jason Crawford

(74) *Attorney, Agent, or Firm* — H.C. Park & Associates, PLC

(57) ABSTRACT

An LED lighting apparatus capable of color temperature control includes a color temperature controller to receive a color temperature selection signal and output first and second control signals; a LED driver connected a plurality of LED groups; and a LED selection circuit including a first switch connected to a first node to which a rectified voltage is applied and receiving the first control signal, a first LED group selectively connected to the first node by the first switch, a second LED group connected in scales with the first LED group, a third LED group selectively connected to the first node by the first switch, a fourth LED group connected in series with the third LED group, and a second switch for selectively connecting the output terminal of the second LED group or the fourth LED group to the LED driver by receiving the second control signal.

16 Claims, 13 Drawing Sheets

Related U.S. Application Data

(60) Provisional application No. 62/543,039, filed on Aug. 9, 2017.

(51) Int. Cl.
*H05B 45/44* (2020.01)
*F21V 23/04* (2006.01)

(58) Field of Classification Search
CPC ..... H05B 45/44; H05B 45/50; H05B 45/56; F21V 23/04
See application file for complete search history.

(56) References Cited

U.S. PATENT DOCUMENTS

| | | | | |
|---|---|---|---|---|
| 8,587,205 | B2 | 11/2013 | Ter Weeme et al. | |
| 9,185,759 | B2 | 11/2015 | Nieberlein et al. | |
| 10,499,471 | B2 * | 12/2019 | Bong | H05B 45/20 |
| 2006/0109219 | A1 | 5/2006 | Ronbinson et al. | |
| 2013/0057171 | A1 | 3/2013 | Liscinsky et al. | |
| 2014/0042920 | A1 | 2/2014 | Chou | |
| 2014/0111101 | A1 | 4/2014 | McRae | |
| 2014/0184081 | A1 * | 7/2014 | Yeh | H05B 45/44 315/122 |
| 2016/0381761 | A1 * | 12/2016 | Tseng | H05B 45/22 315/158 |
| 2017/0265260 | A1 * | 9/2017 | Briggs | H05B 47/19 |
| 2018/0249547 | A1 | 8/2018 | Wang et al. | |
| 2019/0306942 | A1 | 10/2019 | Hopwood et al. | |
| 2020/0375001 | A1 * | 11/2020 | Jung | H05B 45/20 |

FOREIGN PATENT DOCUMENTS

| | | |
|---|---|---|
| DE | 102012006341 | 10/2013 |
| WO | 2004100612 | 11/2004 |
| WO | 2010103480 | 9/2010 |

OTHER PUBLICATIONS

European Extended Search Report dated Oct. 29, 2018, issued in European Patent Application No. 18187803.4.

* cited by examiner

LED LIGHTING APPARATUS CAPABLE OF COLOR TEMPERATURE CONTROL

CROSS-REFERENCE TO RELATED APPLICATION

This application is a Divisional of U.S. patent application Ser. No. 16/044,515, filed on Jul. 25, 2018, and claims the benefit of U.S. Provisional Patent Application No. 62/543,039, filed on Aug. 9, 2017, which is hereby incorporated by reference for all purposes as if fully set forth herein.

BACKGROUND

Field

Exemplary embodiments relate generally to an electronic device and, more specifically, to a LED lighting apparatus capable of color temperature control.

Description of the Background

In order to drive Light-Emitting Diodes (LEDs) using a rectified voltage, an illumination apparatus including LEDs may convert an AC voltage to a rectified voltage and emit light from the LEDs according to the level of the rectified voltage.

However, in the related art, since a red LED, a blue LED, and a green LED are used for various color temperature lighting applications and the brightness of each of the red LED, the blue LED, and the green LED is controlled, the structure of the LED driving circuit is complicated and increases the manufacturing cost.

The above information disclosed in this Background section is only for understanding of the background of the inventive concepts, and, therefore, it may contain information that does not constitute prior art.

SUMMARY

Devices constructed according to exemplary embodiments of the invention are capable of providing an LED lighting device capable of color temperature control including an LED selection circuit.

Additional features of the inventive concepts will be set forth in the description which follows, and in part will be apparent from the description, or may be learned by practice of the inventive concepts.

According to exemplary embodiments, an LED illumination apparatus capable of color temperature control includes: a color temperature controller to receive a color temperature selection signal and output a control signal; a LED driver connected to a plurality of LED groups and to control driving current to be constant, the driving current flowing in each LED group; and a LED selection circuit including a first switch connected to a first node to which a rectified voltage is applied and receiving a first control signal, a first LED group selectively connected to the first node by the first switch, a second LED group connected in series with the first LED group, a third LED group selectively connected to the first node by the first switch, a fourth LED group connected in series with the third LED group, and a second switch for selectively connecting the output terminal of the second LED group or the fourth LED group to the LED driver by receiving a second control signal. The node between the first LED group and the second LED group and the node between the third LED group and the fourth LED group are electrically connected to each other, and the color temperatures of the first LED group and the second LED group are substantially equal but different from the color temperature of third LED group, and the color temperatures of the third LED group and the fourth LED group are substantially equal.

The first LED group and second LED group may have color temperatures of about 1500K to about 3000K and the third LED group and the fourth LED group may have color temperatures of about 4000K to about 7000K.

The LED selection circuit may further include a first resistor connected between an output terminal of the first LED group and an input terminal of the second LED group.

The LED selection circuit may further include a second resistor connected between an output terminal of the third group and an input terminal of the fourth LED group. The resistance value of the first resistor may be smaller than that of the second resistor.

The LED lighting apparatus may further include a capacitor between a node between the first LED group and the second LED group and the LED driver.

The LED selection circuit may further include a fifth LED group selectively connected to the first node by the first switch, and a sixth LED group connected in series with the fifth LED group. A node between the first LED group and the second LED group and a node between the fifth. LED group and the sixth LED group may be electrically connected to each other, and the color temperature of the fifth LED group may be substantially the same as the color temperature of the sixth LED group but is different from the color temperature of the first LED group and the third LED group.

The fifth LED group and sixth LED group may have color temperatures of about 3000K to about 4000K.

According to another exemplary embodiment, an LED illumination apparatus capable of color temperature control includes a color temperature controller to receive a color temperature selection signal and output a control signal; a LED driver connected to a plurality of LED groups and to control driving current to be constant, the driving current flowing in each LED group; and a LED selection circuit including a first switch connected to a first node to which a rectified voltage is applied and receiving a first control signal, a first LED group selectively connected to the first node by the first switch, a second LED group selectively connected to the first node by the first switch, a second switch connected to the output terminal of the first LED group and the second LED group, the first and second LED groups being connected in parallel, a third LED group selectively connected to the output terminal of the first and second LED groups by the second switch, and a fourth LED group selectively connected to the output terminal of the first and second LED groups by the second switch. The color temperatures of the first LED group and the third LED group are substantially equal but different from the color temperature of second LED group, and the color temperatures of the second LED group and the fourth LED group are substantially equal.

The LED selection circuit may further include a third switch connected to the output terminal of the third LED group and the fourth LED group, the third and the fourth LED groups being connected in parallel, a fifth LED group selectively connected to the output terminal of the third and fourth LED groups by the third switch, and a sixth LED group selectively connected to the output terminal of the third and fourth LED groups by the third switch. The color temperature of the fifth LED group may be substantially equal to the color temperature of first LED group, but different from the color temperature of second LED group, and the color temperature of the sixth LED group is substantially equal to the color temperature of the second LED group.

The first LED group may have a color temperature of about 1500K to about 3000K and the second LED group has a color temperature of about 4000K to about 7000K.

The LED selection circuit may further include a first resistor connected between an output terminal of the first LED group and the second switch.

The LED selection circuit may further include a second resistor connected between an output terminal of the second LED group and the second switch, and the resistance value of the first resistor is smaller than that of the second resistor.

According to the exemplary embodiments, an LED illumination apparatus capable of color temperature control including an LED selection circuit may be provided.

Exemplary embodiments of the present invention are capable of providing an LED lighting device in which the configuration of an LED driving circuit is simplified by utilizing an LED selection circuit and a color temperature controller.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
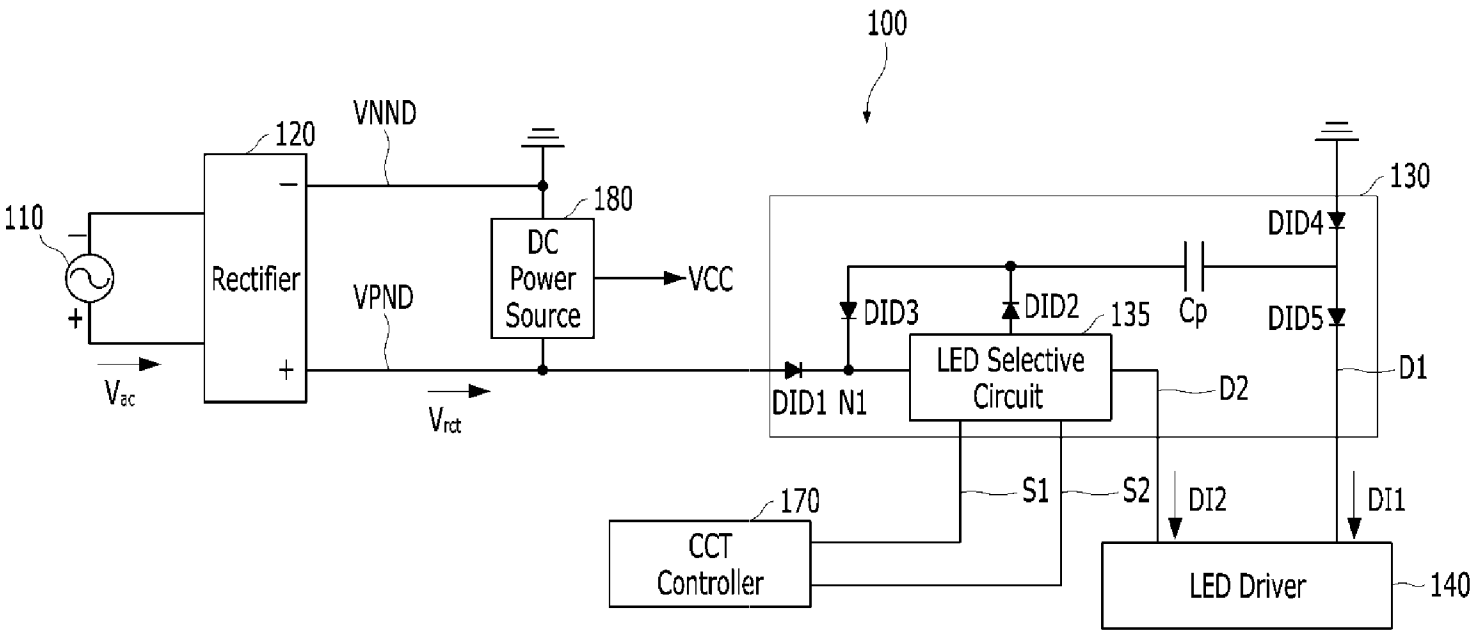
FIG. 1 is a block diagram of an LED lighting apparatus according to an exemplary embodiment of the present invention.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms first, second, etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Various exemplary embodiments are described herein with reference to sectional illustrations that are schematic illustrations of idealized exemplary embodiments and/or intermediate structures. As such, variations from the shapes of the illustrations as a result, for example, of manufacturing techniques and/or tolerances, are to be expected. Thus, exemplary embodiments disclosed herein should not be construed as limited to the particular illustrated shapes of regions, but are to include deviations in shapes that result from, for instance, manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the drawings are schematic in nature and their shapes are not intended to illustrate the actual shape of a region of a device and are not intended to be limiting.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

Figure 2:
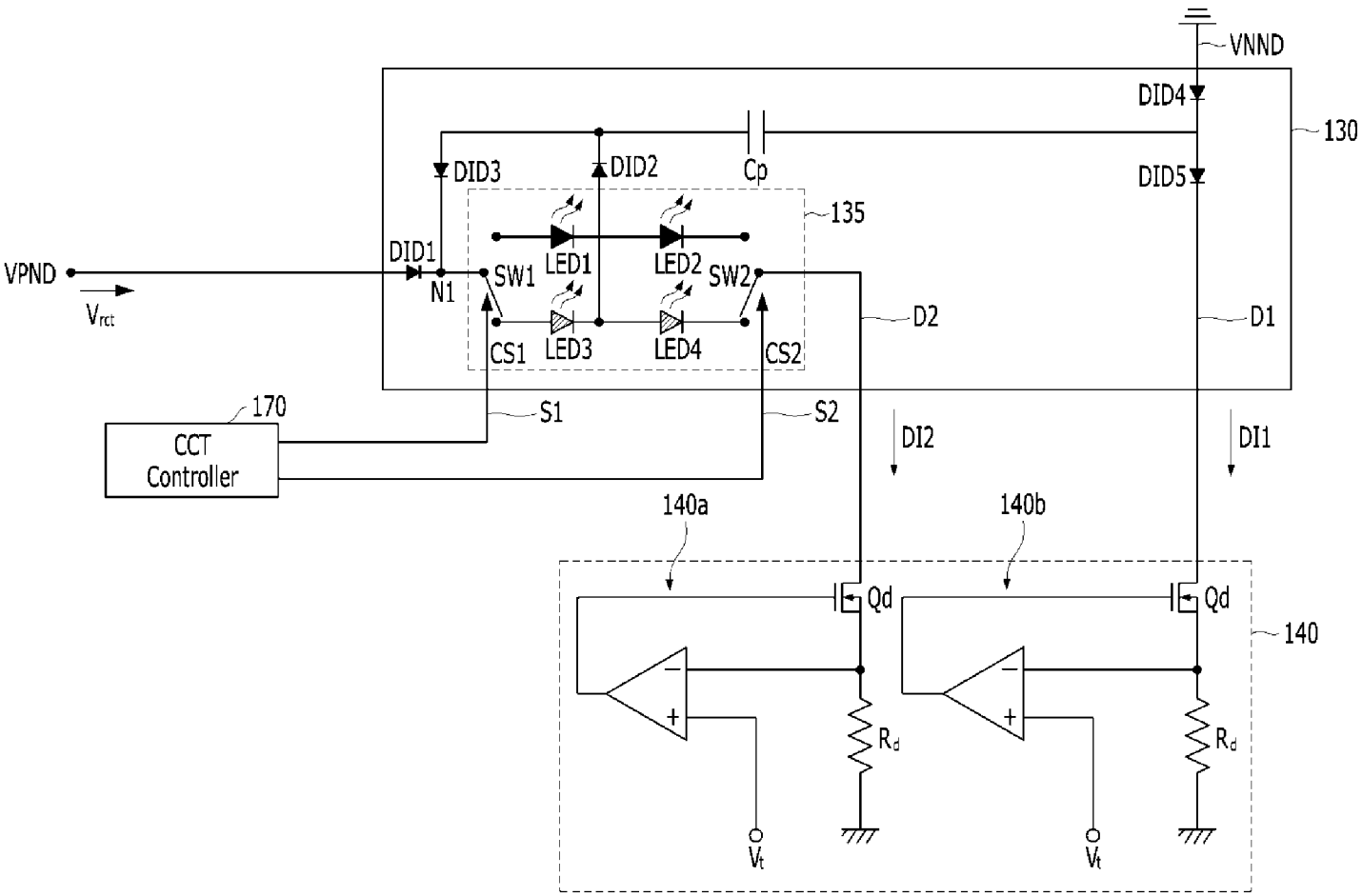
FIG. 2 is a circuit diagram showing an exemplary embodiment of the light emitting circuit, the LED selecting circuit, the LED driver, and the color temperature controller of FIG. 1.

FIG. 1 is a block diagram of an LED lighting apparatus according to an exemplary embodiment of the present invention, FIG. 2 is a circuit diagram showing an exemplary embodiment of the light emitting circuit, the LED selecting circuit, the LED driver, and the color temperature controller of FIG. 1.

Referring to FIG. 1, the illumination apparatus 100 is connected to an AC power source 110 and receives an AC voltage $V_{ac}$. The illumination apparatus 100 may include a rectifier 120, a light emitting circuit 130, a light emitting; diode (LED) selection circuit 135, an LED driver 140, a color temperature controller 170, and a DC power source 180.

The rectifier 120 is configured to rectify the AC voltage $V_{ac}$ and output the rectified voltage $V_{rct}$ through the first power supply node VPND and the second power supply node VNND. The rectified voltage $V_{rct}$ is output to the light emitting circuit 130.

As an exemplary embodiment, the illumination apparatus 100 may further include a surge protection circuit (not shown) configured to protect the internal configurations of the illumination apparatus 100 from over-voltage and/or over-current. The surge protection circuit may, for example, be connected between the first and second power supply nodes (VPND, VNND).

The light emitting circuit 130 is connected between the first and second power supply nodes VPND and VNND. The light emitting circuit 130 receives the rectified voltage $V_{rct}$ through the first and second power supply nodes VPND and VNND and emits light using the rectified voltage $V_{rct}$.

The light emitting circuit 130 may include an LED selection circuit 135 and a capacitor Cp. The LED selecting circuit 135 may include a first LED group LED1, a second LED group LED2, A third LED group LED3, a fourth LED group LED4, a first switch SW1, and a second switch SW2. As an exemplary embodiment, the color temperature of LED1 and the color temperature of LED2 are substantially equal but different from the color temperature of LED3. The color temperature of LED3 and the color temperature of LF may be substantially the same. The LED1 and LED2 may have a color temperature of about 1500K to about 3000K and the LED3 and LED4 may have a color temperature of about 4000K to about 7000K.

The LED selection circuit 135 and the capacitor Cp are connected to the LED driver 140 through the driving nodes D1 and D2. In FIG. 2, the LED selection circuit 135 is shown as including four LED groups LED1, LED2, LED3, and LED4 and two switches SW1 and SW2. However, embodiments of the present invention are not limited thereto. The number of LED groups, the number of switches, and the number of capacitors included in the light emitting circuit 130, the connection relationship between the LED groups, the switches and the capacitors, the driving groups connecting the LED groups and the capacitors to the LED driver 140 may vary in various ways.

Figure 3A:
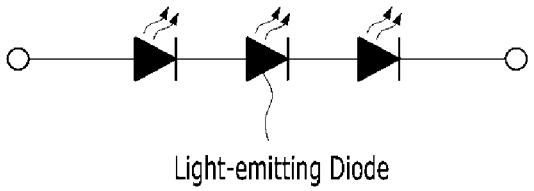
FIGS. 3A, 3B, 3C, and 3D are circuit diagrams illustrating exemplary embodiments of the LED group of FIG. 1.
Figure 3B:
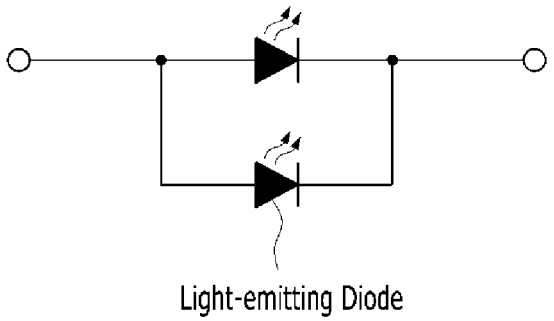
Figure 3C:
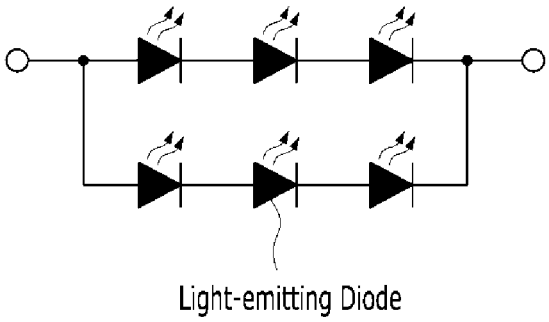
Figure 3D:
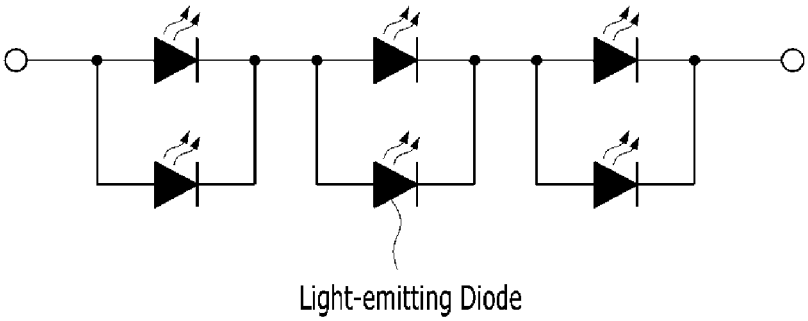

Each of the first to fourth LED groups LED1, LED2 LED3 and LED4 may include at least one LED. The number of LEDs included in each LED group, and the connection relationship of the LEDs may be variously changed. Exemplary embodiments of each LED group are shown in FIGS. 3A-3D. Referring to FIG. 3A, each LED group may include a plurality of LEDs connected in series. Referring to FIG. 3B, each LED group may include a plurality of LEDs connected in parallel. Referring to FIG. 3C, each LED group includes subgroups connected in parallel to each other, and each subgroup may include LEDs connected in series, Referring to FIG. 3D, each LED group includes subgroups serially connected to each other, and each subgroup may include a plurality of LEDs connected in parallel. According to these embodiments, the first LED group LED1 and the second LED group LED2 may have the same forward voltage or different forward voltages. The forward voltage is the threshold voltage that can drive that group of LEDs.

Referring to FIGS. 1 and 2, the first and second LED groups LED1 and LED2 may be connected in series between the first power supply node VPND and the second driving node D2. The capacitor Cp may be connected between the output terminal of the first LED group LED1 (or the input terminal of LED2) and the first drive node D1. The capacitor Cp may be charging or discharging according to the level of the rectified voltage $V_{rct}$ and may provide current to at least one of the first and second LED groups LED1 and LED2 when the capacitor Cp is discharging. Thus, by the capacitor Cp, the first and second LED groups LED1 and LED2 can emit light even when the level of the rectified voltage $V_{rct}$ is lowered.

As an exemplary embodiment, the light emitting circuit 130 may further include first to fifth diodes DID1 to DID5 for preventing backflow. The first diode DID1 is connected between the first power node VPND and the first LED group LED1 and blocks the current flowing from the first LED group LED1 to the first power node VPND. The second diode DID2 is connected between the output terminal of the first LED group LED1 (or the input terminal of the LED2) and the capacitor Cp, and blocks the current flowing from the capacitor Cp to the output terminal of the first LED group LED1. The third diode DID3 is connected between the capacitor Cp and the input terminal N1 of the first LED group LED1 and blocks a current flowing from the input terminal N1 of the first LED group LED1 to the capacitor Cp. The fourth and fifth diodes DID4 and DID5 are connected between the ground node (i.e., VNND) and the first driving node D1, The branch node between the fourth and fifth diodes DID4 and DID5 is connected to the capacitor Cp. The fourth diode DID4 blocks the current flowing from the corresponding branch node to the ground node, and the fifth diode DID5 blocks the current flowing from the first drive node D1 to the corresponding branch node.

The LED driver 140 is connected to the light emitting circuit 130 via the first and second driving nodes D1 and 132. The LED driver 140 is configured to drive the light emitting circuit 130 by applying first and second driving currents DI1 and DI2 to the first and second driving nodes D1 and D2, respectively. The higher the level of each driving current, the larger the amount of light emitted by the LED group through which the driving current flows.

The color temperature controller 170 may receive the color temperature selection signal and output a control signal for controlling the operation of the switch of the LED selection circuit 135. The color temperature selection signal can be received through a communication network. Various types of communication networks may be used for the communication network. Examples of the communication network include wireless communication methods such as a wireless LAN (WLAN), a Wi-Fi, a Wibro, a WiMAX, a High Speed Downlink Packet Access (HSDPA) and wired communication methods such as Ethernet, xDSL, HFC (Hybrid Fiber Coax), FTTC; (Fiber to the Curb) and FTTH (Fiber To The Home). Meanwhile, the communication network is not limited to the above-described communication methods, and may include all other known or later-developed communication methods in addition to the communication methods described above.

The DC power source 180 is connected between the first power supply node VPND and the second power supply node VNND and is configured to generate the DC voltage VCC using the rectified voltage $V_{rct}$. As an example, the DC power source 180 may be a band gap reference circuit. The DC voltage VCC may be provided as the operating voltage of the LED driver 140 and the color temperature controller 170.

Figure 4A:
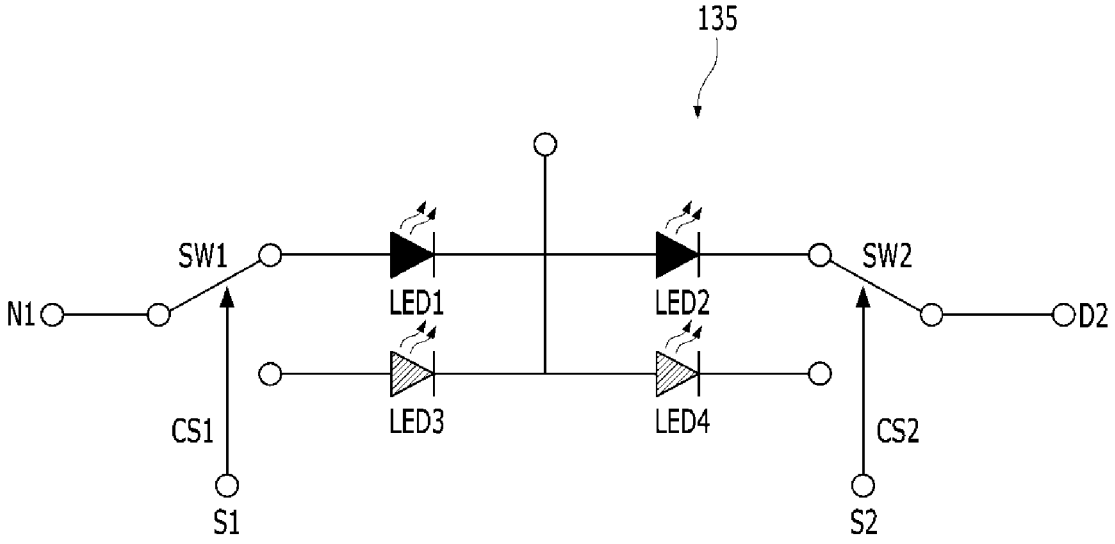
FIGS. 4A, 4B, and 4C are circuit diagrams showing exemplary embodiments of the LED selection circuit shown in FIG. 1.
Figure 4B:
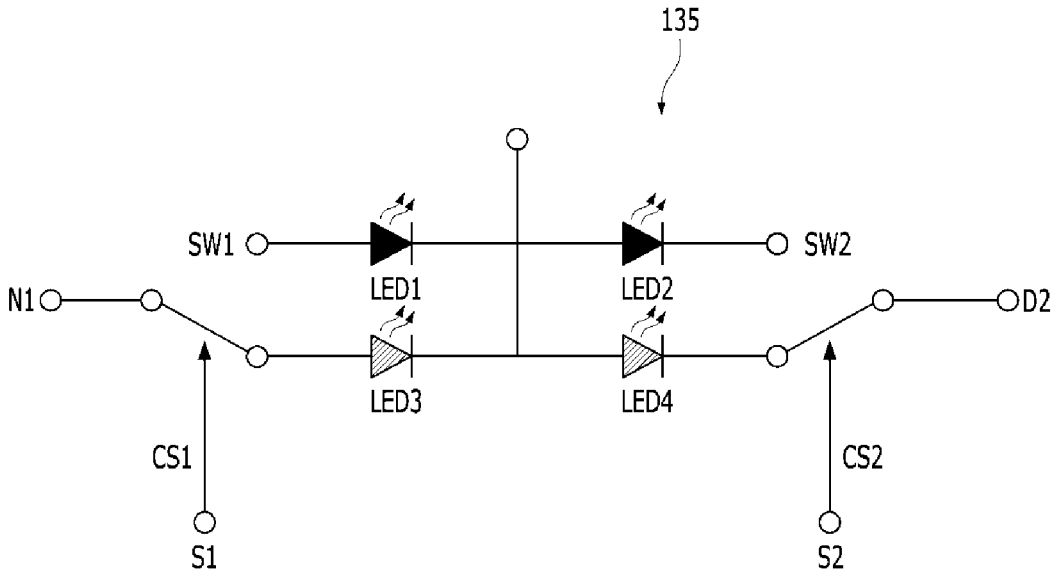
Figure 4C:
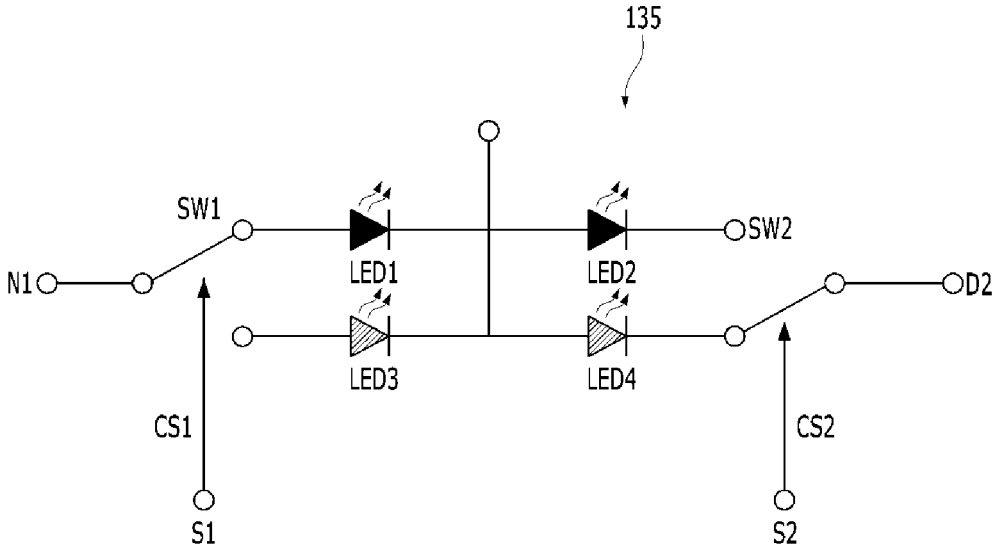

FIGS. 4A, 4B, and 4C are circuit diagrams showing exemplary embodiments of the LED selection circuit shown in FIG. 1.

Referring to FIGS. 4A to 4C, the LED selection circuit 135 includes a first switch SW1 that is connected to a node N1 to which the rectified voltage $V_{rct}$ is applied and receiving a first control signal CS1 from the color temperature controller 170, a first LED group LED1 selectively connected to the node N1 to which a rectified voltage is applied by the first switch SW1, a second LED group LED2 connected in series with the first LED group LED1, a third LED group LED3 selectively connected to the node N1 to which a rectified voltage is applied by the first switch SW1, a fourth LED group LED4 connected in series with the third LED group LED3, and a second switch SW2 for selectively connecting the output terminal of the second LED group LED2 or the fourth LED group LED4 to the LED driver 140 by receiving the second control signal CS2. The nodes between the first LED group LED1 and the second LED group LED2 and the nodes between the third LED group LED3 and the fourth LED group LED4 are electrically connected to each other.

As an exemplary embodiment, the color temperature of the first LED group LED1 and the color temperature of the second LED group LED2 are substantially equal but different from the color temperature of the third LED group LED3. The color temperature of the third LED group LED3 and the color temperature of the fourth LED group LED4 may be substantially equal. The first LED group LED1 and the second group LED2 may have a color temperature of about 1500K to about 3000K. The third LED group LED3 and the fourth LED group LED4 may have a color temperature of about 4000K to about 7000K, Referring to FIG. 4A, the first switch SW1 connects the input terminal of the first LED group LED1 with the node N1 to which the rectified voltage is applied by the first control signal CS1. The second switch SW2 connects the output terminal of the second LED group LED2 to the LED driver 140 by the second control signal CS2. In this case, the driving current can flow through the first LED group LED1 and the second LED group LED2. As an example, the illumination apparatus 100 may emit warm-white color light having a color temperature of about 1500K to about 3000K.

Referring to FIG. 4B, the first switch SW1 connects the input terminal of the third LED group LED3 with the node N1 to which the rectified voltage is applied by the first control signal CS1. The second switch SW2 connects the output terminal of the fourth LED group LED4 with the LED driver 140 by the second control signal CS2. In this case, the driving current can flow through the third LED group LED3 and the fourth LED group LED4. As an example, the illumination apparatus 100 may emit cool-white color light having a color temperature of about 4000K to about 7000K.

Referring to FIG. 4C, the first switch SW1 connects the input terminal of the first LED group LED1 with the node N1 to which the rectified voltage is applied by the first control signal CS1. The second switch SW2 connects the output terminal of the fourth LED group LED4 with the LED driver 140 by the second control signal CS2. In this case, the driving current flows through the first LED group LED1 and the fourth LED group LED4. As the exemplary embodiment, since the first LED group LED1 and the fourth LED group LED4 emit light, the illumination apparatus 100 may emit light between warm and cool color light having a color temperature. That is, the number of LEDs of each of the first LED group LED1 and the fourth LED group LED4 can be adjusted so that light having a desired color temperature ranging from 3000K to 4000K.

In this manner, the operation of the first switch SW1 and the second switch SW2 can be controlled through the first control signal CS1 and the second control signal CS2. Also, the number and arrangement of the LEDs of the first through fourth LED groups LED1, LED2, LED3, and LED4 may be adjusted so that the illumination apparatus emits light having a desired color temperature.

Figure 5:
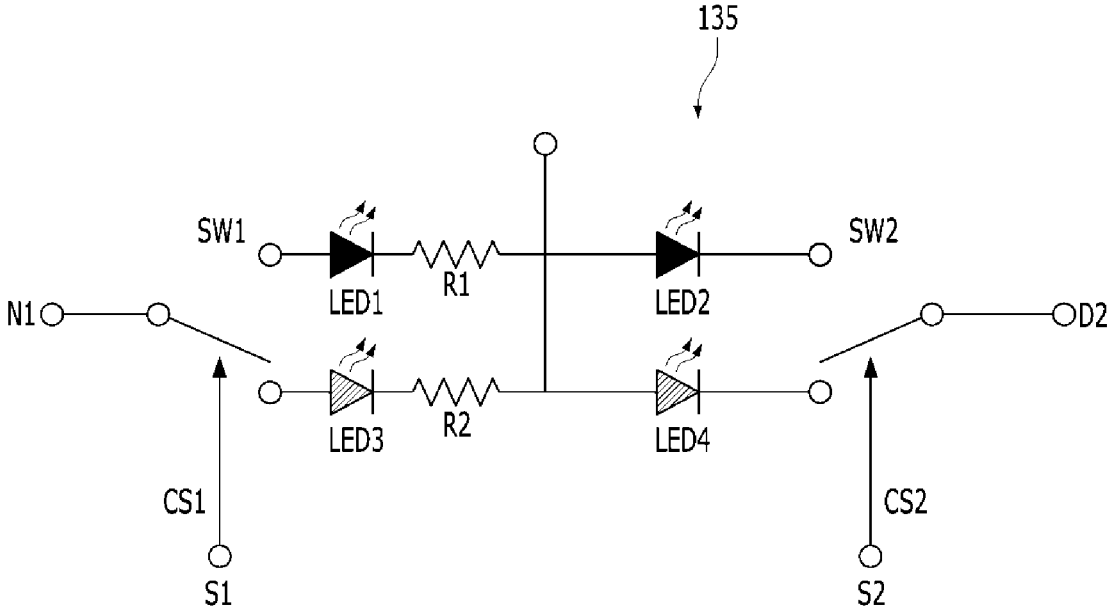
FIG. 5 is a circuit diagram showing another exemplary embodiment of the LED selection circuit shown in FIG. 1.

FIG. 5 is a circuit diagram showing another exemplary embodiment of the LED selection circuit shown in FIG. 1.

Referring to FIG. 5, the LED selection circuit 135 may include a first switch SW1 connected to a node N1 to which a rectified voltage is applied and receiving a first control signal CS1 from the color temperature controller 170, a first LED group LED1 electively connected to the node N1 to which a rectified voltage is applied by the first switch SW1, a first resistor R1 connected in series with the first LED group LED1, a second LED group LED2 connected in series with the first resistor R1, a third LED group LED3 electively connected to the node N1 to which a rectified voltage is applied by the first switch SW1, a second resistor R2 connected in scales with the third LED group LED3, a fourth LED group LED4 connected in series with the second resistor R2, and a second switch SW2 for selectively connecting the output terminal of the second LED group LED2 or the fourth LED group LED4 to the LED driver 140 by receiving the second control signal CS2. The node between the first resistor R1 and the second LED group LED2 and the node between the second resistor R2 and the fourth LED group LED4 are electrically connected to each other.

The first resistor R1 and the second resistor R2 operate as balance resistors. The color temperatures of the first LED group LED1 and the second LED group LED2 are different from those of the third LED group LED3 and the fourth LED group LED4. Accordingly, in terms of brightness, the brightness of each color temperature may be different. The balance resistor may be a resistor for preventing the difference in brightness from being adjusted. By adjusting the values of the first resistor R1 and the second resistor R2, the brightness difference due to the difference in color temperature may be corrected, and it may keep the brightness always constant.

As an exemplary embodiment, the first LED group LED1 and the second LED group LED2 have a color temperature of about 1500K to about 3000K, and the third LED group LED3 and the fourth LED group LED4 have a color temperature of about 4000K to about 7000K. In this case, the brightness of the illumination apparatus can be kept constant by adjusting the second resistor R2 to be larger than the first resistor R1. The first resistor R1 may be omitted in consideration of the efficiency of the illumination apparatus.

The configuration except for the first resistor R1 and the second resistor R2 is the same as in FIGS. 4A to 4C. In the same manner, the operation of the first switch SW1 and the second switch SW2 through the first control signal CS1 and the second control signal CS2, and the number of the LEDs and the arrangement of the LEDs LED1, LED2, LED3, and LED4 may be adjusted so that the illumination apparatus emits light having a desired color temperature.

Figure 6A:
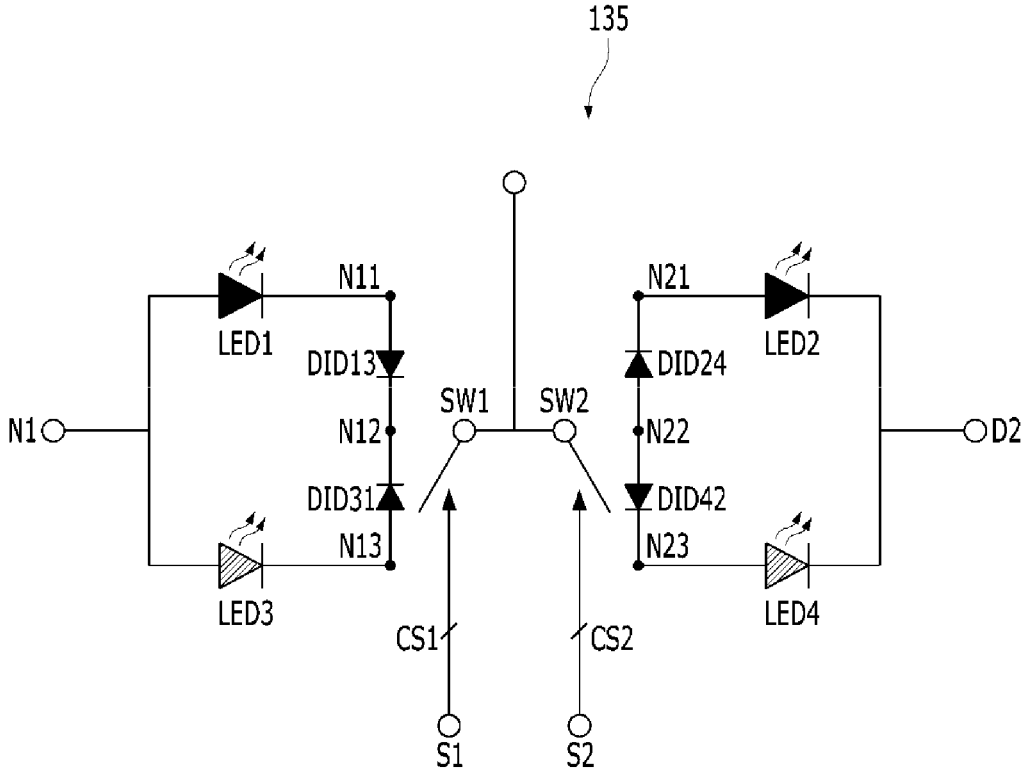
FIGS. 6A and 6B are circuit diagrams showing still another exemplary embodiment of the LED selection circuit shown in FIG. 1.
Figure 6B:
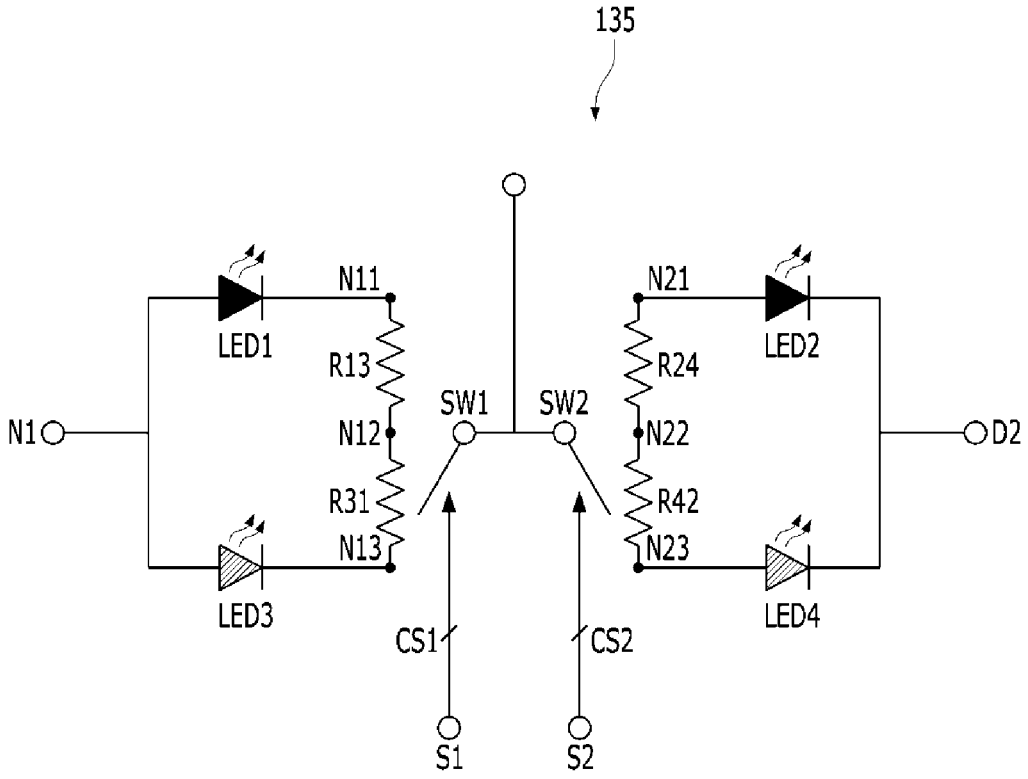

FIGS. 6A and 6B are circuit diagrams showing still another exemplary embodiment of the LED selection circuit shown in FIG. 1.

Referring to FIG. 6A, the LED selection circuit 135 may include a first LED group LED1 and a third LED group LED3 connected in parallel to a node N1 to which a rectified voltage is applied, a first diode DID13 and a second diode DID31 connected in series between the output terminal N11 of the first LED group LED1 and the output terminal N13 of the third LED group LED3, a first switch SW1 receiving a first control signal CS1 from color temperature controller 170, a second switch SW2 connected to the first switch SW1 and receiving the second control signal CS2, a second LED group LED2, a fourth LED group LED4 connected in parallel with the second LED group LED2, and a third diode DID24 and a fourth diode DID42 connected in series between the input terminal N21 of the second LED group LED2 and the input terminal N23 of the fourth LED group LED4. The output terminal of the second LED group LED2 and the output terminal of the fourth LED group LED4 are connected in parallel and connected to the LED driver 140 through the second driving node D2.

As an exemplary embodiment, the color temperature of LED1 and the color temperature of LED2 are substantially equal but different from the color temperature of LED3. The color temperature of LED3 and the color temperature of LED4 may be substantially the same. The LED1 and LED2 may have a color temperature of about 1500K to about 3000K and the LED3 and LED4 may have a color temperature of about 4000K to about 7000K.

As an exemplary embodiment, the first switch SW1 may selectively connect the output terminal N11 of the first LED group LED1, the node N12 between the first diode DID13 and the second diode DID31, and the output terminal N13 of the third LED group LED3 to the second LED group LED2 and/or the fourth LED group LED4 through the first control signal CS1. The second switch SW2 may selectively connect the input terminal N21 of the second LED group LED2, the node N22 between the third diode DID24 and the fourth diode DID42, and the input terminal N23 of the fourth LED group LED4 to the first LED group LED1 and/or the third LED group LED3 through the second control signal CS2.

In an exemplary embodiment, the first diode DID13 blocks the current flowing from the output terminal N13 of the third LED group LED3 to the first LED group LED1. The second diode DID31 blocks the current flowing from the output terminal N11 of the first LED group LED1 to the third LED group LED3. The third diode DID24 blocks the current flowing from the input terminal N21 of the second LED group LED2 to the fourth LED group LED4. The fourth diode DID42 blocks the current flowing from the input terminal N23 of the fourth LED group LED4 to the second LED group LED2.

The illumination apparatus 100 may control the operation of the first switch SW1 and the second switch SW2 through the first control signal CS1 and the second control signal CS2, and also control the number and arrangement of LEDs of each of the first to fourth LED groups LED1, LED2, LED3, and LED4 so that the lighting device emits light having a desired color temperature. As an exemplary embodiment, it is possible to control the light emission of various combinations of LED groups such as the light emission of LED1 and LED2, the light emission of LED1 and LED4, the light emission of LED2 and LED3, the light emission of LED3 and LED4, the light emission of LED1 to LED3, or the whole light emission of the first to fourth LED groups LED1, LED2, LED3, and LED4 through the control of the first switch SW1 and the second switch SW2. In this case, as an example, the illumination apparatus 100 may emit light such as a warm-white color having a color temperature of about 1500K to about 3000K, a cool-white color having a color temperature of about 4000K to about 7000K, or light having a color temperature between warm-white and cool-white.

Referring to FIG. 6B, the LED selection circuit 135 may include a first LED group LED1 and a third LED group LED3 connected in parallel to a node N1 to which a rectified voltage is applied, a first resistor R13 and a second resistor R31 connected in series between the between the output terminal N11 of the first LED group LED1 and the output terminal N13 of the third LED group LED3, a first switch SW1 receiving a first control signal CS1 from color temperature controller 170, a second switch SW2 connected to the first switch SW1 and receiving the second control signal CS2, a second LED group LED2, a fourth LED group LED4 connected in parallel with the second LED group LED2, and a third resistor R24 and a fourth resistor R42 connected in series between the input terminal N21 of the second LED group LED2 and the input terminal N23 of the fourth LED group LED4. The output terminal of the second LED group LED2 and the output terminal of the fourth LED group LED4 are connected in parallel and connected to the LED driver 140 through the second driving node D2.

As an exemplary embodiment, the color temperature of LED1 and the color temperature of LED2 are substantially equal but different from the color temperature of LED3. The color temperature of LED3 and the color temperature of LED4 may be substantially the same. The LED1 and LED2 may have a color temperature of about 1500K to about 3000K and the LED3 and LED4 may have a color temperature of about 4000K to about 7000K.

As an exemplary embodiment, the first switch SW1 may selectively connect the output terminal N11 of the first LED group LED1, the node N12 between the first resistor R13 and the second resistor R31, and the output terminal N13 of the third LED group LED3 to the second LED group LED2 and/or the fourth LED group LED4 through the first control signal CS1. The second switch SW2 may selectively connect the input terminal N21 of the second LED group LED2, the node N22 between the third resistor R24 and the fourth resistor R42, and the input terminal N23 of the fourth LED group LED4 to the first LED group LED1 and/or the third LED group LED3 through the second control signal CS2.

When the output terminal N11 of the LED1 is connected to the LED2 and/or the LED4 by the first switch SW1, the driving current flowing through the LED1 is greater than the driving current flowing through the LED3 due to the presence of the first resistor R13 and second resistor R31, thereby the LED1 emits brighter than LED3. In the same manner, when the output terminal N13 of the LED3 is connected to the LED2 and/or the LED4 by the first switch SW1, the driving current flowing through the LED3 is greater than the driving current flowing through the LED1 due to the presence of the first resistor R13 and second resistor R31, thereby the LED3 emits brighter than LED1. When the output terminal N11 of the LED1 is connected to the node N12 between the first resistor R13 and the second resistor R31 by the first switch SW1, the brightness between the LED1 and LED3 is not largely different, and the first resistor R13 and the second resistor R31 can operate as balance resistors. The second LED group LED2 and the fourth LED group LED4 are selectively connected to the first LED group LED1 and/or the third LED group LED3 by the second switch SW2. Since the light emission also operates in the same manner, a duplicate description will be omitted.

The illumination apparatus 100 may control the operation of the first switch SW1 and the second switch SW2 through the first control signal CS1 and the second control signal CS2, and also control the number and arrangement of LEDs of each of the first to fourth LED groups LED1, LED2, LED3, and LED4 so that the lighting device emits light having a desired color temperature. As an example, the illumination apparatus 100 may emit light such as a warm-white color having a color temperature of about 1500K to about 3000K, a cool-white color having a color temperature of about 4000K to about 7000K, or light having a color temperature between warm-white and cool-white.

Figure 7:
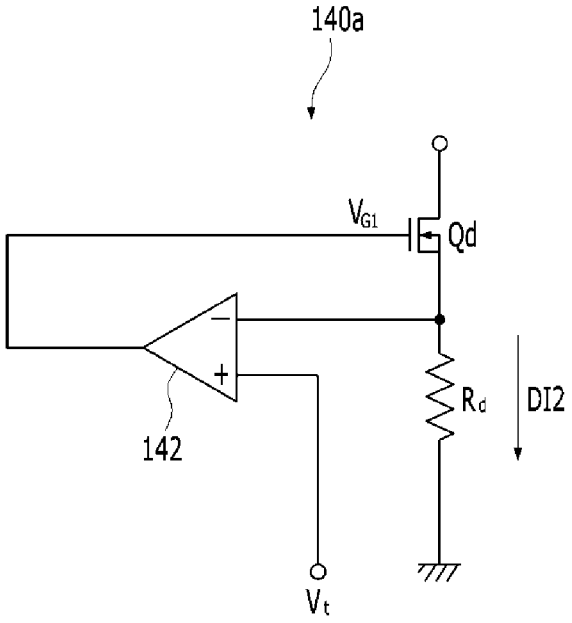
FIG. 7 is a schematic circuit diagram illustrating the operation of the drive current controller shown in FIG. 2.

FIG. 7 is a schematic circuit diagram illustrating the operation of the drive current controller shown in FIG. 2. FIG. 7 illustrates the first drive current controller 140*a* as an example, but the second drive current controller 140*b* may be configured same as the first drive current controller 140*a*.

Referring to FIG. 7, the first drive current controller 140*a* includes a linear amplifier 142, a transistor Qd, and a detection resistor $R_d$. A voltage detected in the detection resistor $R_d$ may be applied to the negative input terminal of the linear amplifier 142, and a target voltage $V_t$ may be applied to the positive input terminal.

The output of the linear amplifier 142 may be input to the gate electrode of the transistor Qd. The transistor Qd may be variously implemented as a switching element for constant current control. The transistor Qd is connected between the output terminal of each of the LED groups LED1 and LED2 and the detection resistor $R_d$ and performs ON/OFF operation in accordance with the output of the linear amplifier 142 applied to the gate electrode.

The transistor Qd and the linear amplifier 142 may be included in a feedback circuit and if the detection voltage at the detection resistor $R_d$ is lower than the target voltage $V_t$, the linear amplifier 142 outputs a high level voltage (e.g., positive voltage), which is applied to the gate electrode of the transistor Qd.

The operation of the first drive current controller 140*a* in the period (first operation period) in which the voltage level of the drive voltage $V_{rct}$ is equal to or higher than the first forward voltage level (1Vf) and less than the second forward voltage level (2Vf) are explained as below.

The first LED group LED1 is turned on during the first operation period. Accordingly, the first drive current controller 140*a* connected to the first LED group LED1 is also activated and the second driving current D12 flowing through the first LED group LED1 is applied to the detection resistor $R_d$ of the first drive current controller 140*a*. The linear amplifier 142 compares the detection voltage input to the negative input terminal with the target voltage $V_t$ input to the positive input terminal and outputs the first gate input voltage $V_{G1}$ corresponding to the difference to the gate electrode of the transistor Qd. As described above, when the detection voltage is less than the target voltage $V_t$, the voltage $V_{G1}$ has a high-level voltage value.

In this case, the voltage $V_{GS}$ between the gate electrode and the source electrode of the transistor Qd is varied by the first gate input voltage $V_{G1}$, and the turn on/off state of the transistor Qd is determined according to the $V_{GS}$ voltage. Specifically, when the $V_{GS}$ voltage rises due to the application of $V_{G1}$ having a high level voltage value, the amount of current flowing through the first LED group LED1 flowing through the transistor Qd to the detection resistor $R_d$ increases. However, when the detection voltage at the detection resistor $R_d$ increases due to the increased current amount, the level of the voltage $V_{G1}$ decreases and the amount of current flowing in the first LED group LED1 decreases correspondingly. That is, the voltage at the detection resistor $R_d$ has a characteristic to follow the target voltage $V_t$, and thereby the second drive current DI2 can be controlled to a constant current.

Figure 8:
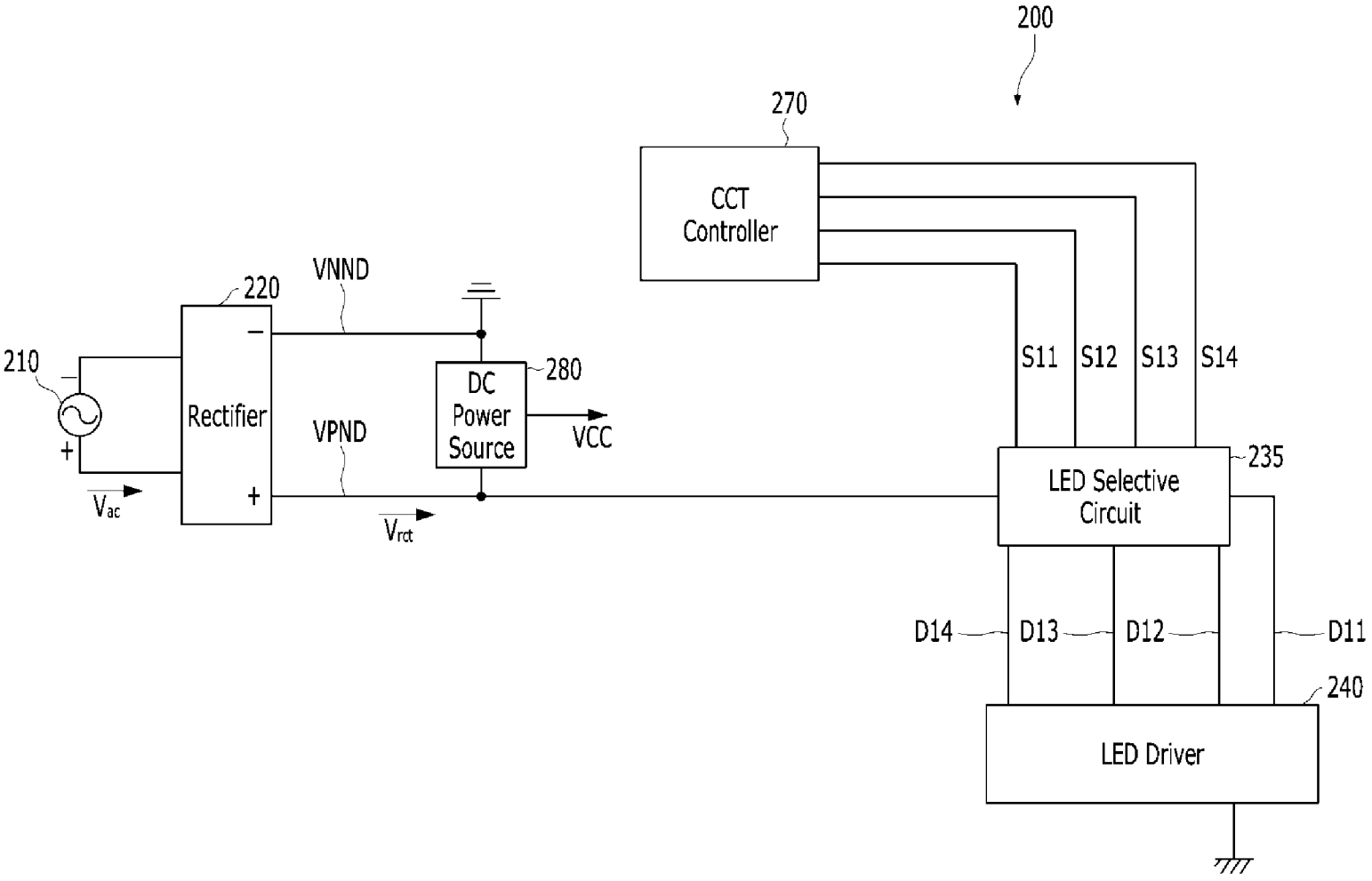
FIG. 8 is a block diagram of an LED lighting apparatus according to another exemplary embodiment.
Figure 9:
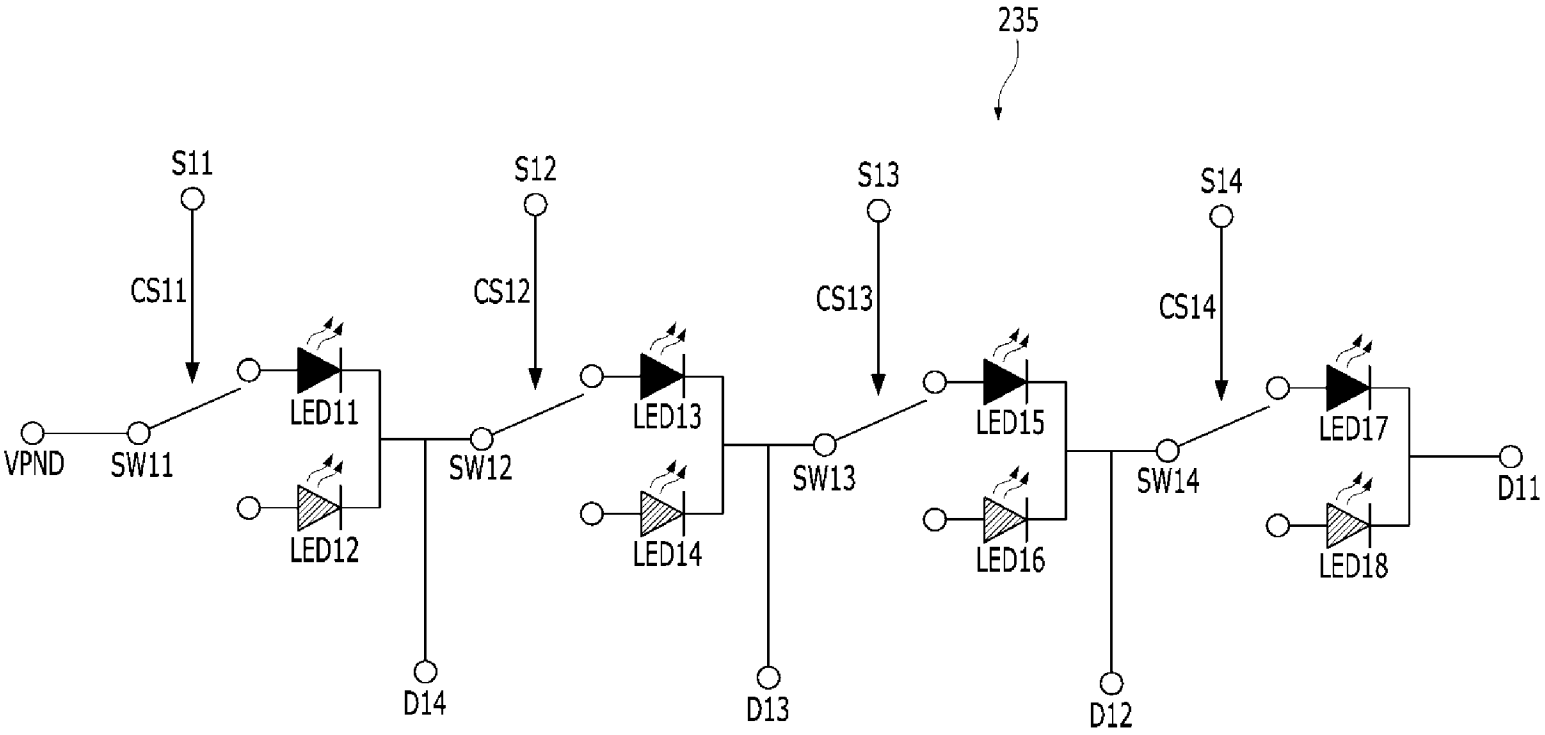
FIG. 9 is a circuit diagram showing an exemplary embodiment of the LED selection circuit shown in FIG. 8.

FIG. 8 is a block diagram of an LED lighting apparatus according to another exemplary embodiment of the present invention. FIG. 9 is a circuit diagram showing an exemplary embodiment of the LED selection circuit shown in FIG. 8.

Referring to FIGS. 8 and 9, the illumination apparatus 200 is connected to the AC power source 210 and receives the AC voltage $V_{ac}$. The illumination apparatus 200 may include a rectifier 220, an LED selection circuit 235, a LED driver 240, a color temperature controller 270, and a DC power source 280.

The rectifier 220 is configured to rectify the AC voltage $V_{ac}$ and output the rectified voltage $V_{rct}$ through the first power supply node VPND and the second power supply node VNND. The rectified voltage $V_{rct}$ is output to the LED selection circuit 235.

The LED selection circuit 235 is connected between the first and second power supply nodes VPND and VNND. The LED selection circuit 235 receives the rectified voltage through the first and second power supply nodes VPND and VNND and emits light using the rectified voltage $V_{rct}$.

The LED selection circuit 235 includes a first LED group LED11, a second LED group LED12, a third LED group LED13, a fourth LED group LED14, a fifth LED group LED15, a sixth LED group LED16, a seventh LED group LED17, the eighth LED group LED18, the first switch SW11, the second switch SW12, the third switch SW13 and the fourth switch SW14. As an exemplary embodiment, the color temperature of LED11, LED13, LED15, and LED17 are substantially the same, but different from the color temperature of LED12. The color temperature of LED12, LED14, LED16, and LED18 may be substantially the same. The LED11, LED13, LED15, and LED17 may have a color temperature of about 1500K to about 3000K and the LED12, LED14, LED16, and LED18 may have a color temperature of about 4000K to about 7000K.

The LED selection circuit 235 is connected to the LED driver 240 through the driving nodes D11, D12, D13, and D14. In FIG. 8, the LED selection circuit 235 is shown as including eight LED groups LED11, LED12, LED13, LED14, LED15, LED16, LED17, LED18 and four switches SW11, SW12, SW13 and SW14. However, the exemplary embodiments of the present invention are not limited thereto. The number of LED groups included in the LED selection circuit 235, the number of switches, and the connection relationship between the LED groups and the switches, the number of driving nodes connecting the LED groups to the LED driver 240 may vary in various ways.

Each of the first to eighth LED groups LED11, LED12, LED13, LED14, LED15, LED16, LED17, and LED18 may include at least one LED. The number of LEDs included in each LED group, and the connection relationship of the LEDs may be variously changed, and are substantially the same as those described in FIGS. 3A to 3D, so that the description thereof will be omitted to avoid redundant description.

The LED driver 240 is connected to the LED selection circuit 235 through the first to fourth driving nodes D11, D12, D13, and D14. The LED driver 240 is configured to drive the LED selection circuit 235 by applying driving currents to the first to fourth driving nodes D11, D12, D13, and D14, respectively. The higher the level of each driving current, the larger the amount of light emitted by the LED group through which the driving current flows.

The color temperature controller 270 may receive the color temperature selection signal and output a control signal for controlling the operation of the switch of the LED selection circuit 235. The color temperature selection signal can be received through a communication network. Various types of communication networks may be used for the communication network. Examples of the communication network include wireless communication methods such as a wireless LAN (WLAN), a Wi-Fi, a Wibro, a WiMAX, a High Speed Downlink Packet Access (HSDPA) and wired communication methods such as Ethernet, xDSL, HFC (Hybrid Fiber Coax), FTTC (Fiber to the Curb) and FTTH (Fiber To The Home). Meanwhile, the communication network is not limited to the above-described communication methods, and may include all other known or later-developed communication methods in addition to the communication methods described above.

The DC power source 280 is connected between the first power supply node VPND and the second power supply node VNND and is configured to generate the DC voltage VCC using the rectified voltage $V_{rct}$. As an example, the DC power source 280 may be a band gap reference circuit. The DC voltage VCC may be provided as the operating voltage of the LED driver 240 and the color temperature controller 270.

Referring to FIG. 9, the LED selection circuit 235 includes a first switch SW11 that is connected to a node VPND to which the rectified voltage $V_{rct}$ is applied and receiving a first control signal CS11 from the color temperature controller 270, a first LED group LED11 selectively connected to the node to which a rectified voltage is applied by the first switch SW11, a second LED group LED12 selectively connected to the node to which a rectified voltage is applied by the first switch SW11, a second switch SW12 that is connected to a fourth driving node D14 and receiving a second control signal CS12 from the color temperature controller 270, a third LED group LED13 selectively connected to the fourth driving node D14 by the second switch SW12, a fourth LED group LED14 selectively connected to the fourth driving node D14 by the second switch SW12, a third switch SW13 that is connected to a third driving node D13 and receiving a third control signal CS13 from the color temperature controller 270, a fifth LED group LED15 selectively connected to the third driving node D13 by the third switch SW13, a sixth LED group LED16 selectively connected to the third driving node D13 by the third switch SW13, a fourth switch SW14 that is connected to a second driving node D12 and receiving a fourth control signal CS14 from the color temperature controller 270, a seventh LED group LED17 selectively connected to the second driving node D12 by the fourth switch SW14, a eighth LED group LED18 selectively connected to the second driving node D12 by the fourth switch SW14.

The output terminal of LED11 and LED12, the output terminal of LED13 and LED14, the output terminal of LED15 and LED16, and the output terminal of LED17 and LED18 are connected in parallel, respectively.

As an exemplary embodiment, the color temperature of LED11, LED13, LED15, and LED17 are substantially the same, but different from the color temperature of LED12. The color temperature of LED12, LED14, LED16, and LED18 may be substantially the same. The LED11, LED13, LED15, and LED17 may have a color temperature of about 1500K to about 3000K and the LED12, LED14, LED16, and LED18 may have a color temperature of about 4000K to about 7000K.

As illustrated in FIGS. 4A to 4C, the illumination apparatus 200 may operate the first to fourth switches SW11, SW12, SW13, and SW14 through the first to fourth control signals CS11, CS12, CS13, and CS14. Further, the illumination apparatus 200 may control the number and arrangement of LEDs of the first to eighth LED groups LED11, LED12, LED13, LED14, LED15, LED16, LED17, and LED18 to emit light having a desired color temperature. As an example, the illumination apparatus 200 may emit a warm-white color having a color temperature of about 1500K to about 3000K, a cool-white color having a color temperature of about 4000K to about 7000K, or light having a color temperature between warm-white and cool-white.

Figure 10:
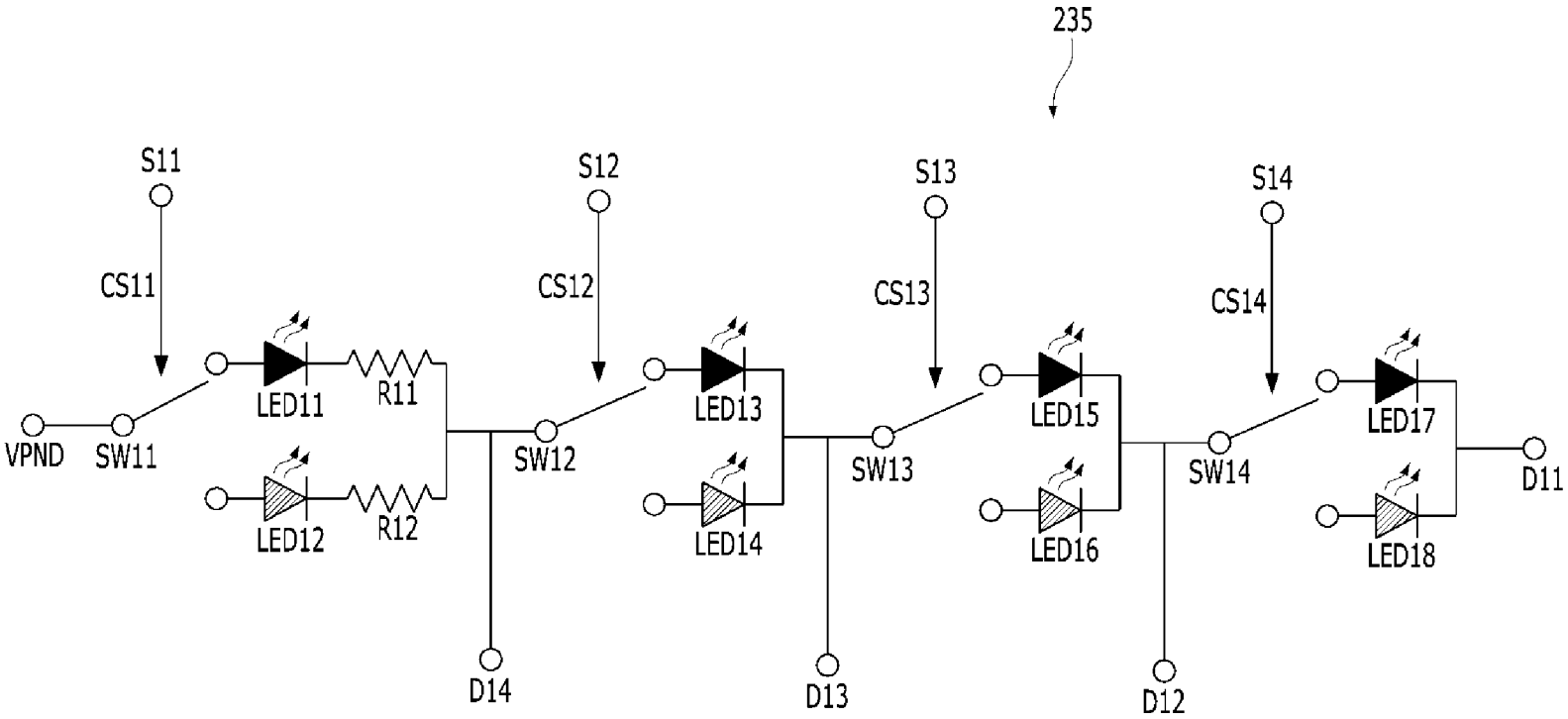
FIG. 10 is a circuit diagram showing another exemplary embodiment of the LED selection circuit shown in FIG. 8.

FIG. 10 is a circuit diagram showing another exemplary embodiment of the LED selection circuit shown in FIG. 8.

Referring to FIG. 10, the LED selection circuit 235 includes a first switch SW11 that is connected to a node VPND to which the rectified voltage $V_{rct}$ is applied and receiving a first control signal CS11 from the color temperature controller 270, a first LED group LED11 selectively connected to the node to which a rectified voltage is applied by the first switch SW11, a first resistor R11 connected in series with the first LED group LED11, a second LED group LED12 selectively connected to the node to which a rectified voltage is applied by the first switch SW11, a second resistor R12 connected in series with the second LED group LED12, a second switch SW12 that is connected to a fourth driving node D14 and receiving a second control signal CS12 from the color temperature controller 270, a third LED group LED13 selectively connected to the fourth driving node D14 by the second switch SW12, a fourth LED group LED14 selectively connected to the fourth driving node D14 by the second switch SW12, a third switch SW13 that is connected to a third driving node D13 and receiving a third control signal CS13 from the color temperature controller 270, a fifth LED group LED15 selectively connected to the third driving node D13 by the third switch SW13, a sixth LED group LED16 selectively connected to the third driving node D13 by the third switch SW13, a fourth switch SW14 that is connected to a second driving node D12 and receiving a fourth control signal CS14 from the color temperature controller 270, a seventh LED group LED17 selectively connected to the second driving node D12 by the fourth switch SW14, a eighth LED group LED18 selectively connected to the second driving node D12 by the fourth switch SW14.

The first resistor R11 and second resistor R12, the output terminal of LED11 and LED12, the output terminal of LED13 and LED14, the output terminal of LED15 and LED16, and the output terminal of LED17 and LED18 are connected in parallel, respectively.

The first resistor R11 and the second resistor R12 operate as balance resistors. The color temperatures of LED11, LED13, LED15, and LED17 are different from the color temperature of LED12, LED14, LED16, and LED18. Accordingly, in terms of brightness, the brightness of each color temperature may be different. The balance resistor may be a resistor for preventing the difference in brightness from being adjusted. By adjusting the values of the first resistor R11 and the second resistor R12, the brightness difference due to the difference in color temperature may be corrected, and it may keep the brightness always constant.

As an exemplary embodiment, the LED11, LED13, LED15, and LED17 have a color temperature of about 1500K to about 3000K, and the LED12, LED14, LED16, and LED18 have a color temperature of about 4000K to about 7000K. In this case, the brightness of the illumination apparatus can be kept constant by adjusting the second resistor R12 to be larger than the first resistor R11. The first resistor R11 may be omitted in consideration of the efficiency of the lighting apparatus.

The configuration, except for the first resistor R11 and the second resistor R12, is the same as that in FIG. 8. In the same manner, the operation of the first to the fourth switch SW11, SW12, SW13, and SW14 through the first to fourth control signal CS1, CS2, CS3, and CS4, and the number of the LEDs and the arrangement of the LEDs in the LED11, LED12, LED13, LED14, LED15, LED16, LED17, and LED18 may be adjusted so that the illumination apparatus emits light having a desired color temperature.

As an example, the illumination apparatus 200 may use an LED selection circuit similar to the LED selection circuit described in FIGS. 6A and 6B. In this case, the illumination apparatus 200 may control the operation of the switches through the control signals, and also control the number and arrangement of LEDs of each of the first to eighth LED groups LED11, LED12, LED13, LED14, LED15, LED16, LED17, and LED18 so that the lighting device emits light having a desired color temperature. As an exemplary embodiment, it is possible to control the light emission of various combinations of LED groups such as the light emission from one of LED11 and LED12, the light emission from one of LED13 and LED14, the light emission from one of LED15 and LED16, the light emission from one of LED17 and LED18 or the whole light emission of the first to eight LED groups through the control of the switches. In this case, as an example, the illumination apparatus 200 may emit light, such as a warm-white color having a color temperature of about 1500K to about 3000K, a cool-white color having a color temperature of about 4000K to about 7000K, or light having a color temperature between warm-white and cool-white.

As described above, according to the exemplary embodiments of the present invention, an LED lighting device capable of color temperature control including an LED selection circuit is provided.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. A light-emitting diode (LED) lighting apparatus comprising:
- a color temperature controller to receive a color temperature selection signal and output a first control signal;
- an LED driver connected to a plurality of LED groups and configured to control driving current to be constant, the driving current flowing in each LED group; and
- an LED selection circuit comprising:
- a first switch connected to a first node to which a rectified voltage is applied and receiving the first control signal,
- a first LED group selectively connected to the first node by the first switch,
- a second LED group selectively connected to the first node by the first switch,
- a second switch connected to an output terminal of the first LED group and the second LED group, the first and second LED groups being connected in parallel,
- a third LED group selectively connected to the output terminal of the first and second LED groups by the second switch, and
- a fourth LED group selectively connected to the output terminal of the first and second LED groups by the second switch,
- wherein color temperatures of the first LED group and the third LED group are substantially equal but different from a color temperature of second LED group, and the color temperatures of the second LED group and the fourth LED group are substantially equal.

2. The LED lighting apparatus of claim 1, wherein the LED selection circuit further comprises:
- a third switch connected to an output terminal of the third LED group and the fourth LED group, the third and the fourth LED groups being connected in parallel;
- a fifth LED group selectively connected to the output terminal of the third and fourth LED groups by the third switch; and
- a sixth LED group selectively connected to an output terminal of the third and fourth LED groups by the third switch,
- wherein a color temperature of the fifth LED group is substantially equal to the color temperature of first LED group, but different from the color temperature of second LED group, and a color temperature of the sixth LED group is substantially equal to the color temperature of the second LED group.

3. The LED lighting apparatus of claim 1, wherein:
- the first LED group has a color temperature of about 1500K to about 3000K; and
- the second LED group has a color temperature of about 4000K to about 7000K.

4. The LED lighting apparatus of claim 1, wherein the LED selection circuit further comprises a first resistor connected between an output terminal of the first LED group and the second switch.

5. The LED lighting apparatus of claim 4, wherein the LED selection circuit further comprises a second resistor connected between an output terminal of the second LED group and the second switch, and wherein a resistance value of the first resistor is less than a resistance value of the second resistor.

6. A light-emitting diode (LED) selecting circuit for a LED lighting apparatus comprising:

a first switch connected to a first node to which a rectified voltage is applied and configured to receive a first control signal, a first LED group selectively connected to the first node by the first switch, a second LED group selectively connected to the first node by the first switch, a second switch connected to an output terminal of the first LED group and the second LED group, the first and second LED groups being connected in parallel, a third LED group selectively connected to the output terminal of the first and second LED groups by the second switch, and a fourth LED group selectively connected to the output terminal of the first and second LED groups by the second switch, wherein color temperatures of the first LED group and the third LED group are substantially equal but different from a color temperature of second LED group, and the color temperatures of the second LED group and the fourth LED group are substantially equal.

7. The LED selecting circuit of claim 6, further comprising:

a third switch connected to an output terminal of the third LED group and the fourth LED group, the third and the fourth LED groups being connected in parallel;

a fifth LED group selectively connected to the output terminal of the third and fourth LED groups by the third switch; and a sixth LED group selectively connected to the output terminal of the third and fourth LED groups by the third switch, wherein a color temperature of the fifth LED group is substantially equal to the color temperature of first LED group, but different from the color temperature of second LED group, and a color temperature of the sixth LED group is substantially equal to the color temperature of the second LED group.

8. The LED selecting circuit of claim 7, further comprising:

a fourth switch connected to an output terminal of the fifth LED group and the sixth LED group, the fifth and the sixth LED groups being connected in parallel;

a seventh LED group selectively connected to the output terminal of the fifth and sixth LED groups by the fourth switch; and an eighth LED group selectively connected to the output terminal of the fifth and sixth LED groups by the fourth switch, wherein a color temperature of the seventh LED group is substantially equal to the color temperature of first LED group, but different from the color temperature of second LED group, and a color temperature of the eighth LED group is substantially equal to the color temperature of the second LED group.

9. The LED selecting circuit of claim 8, wherein the seventh and the eighth LED groups are connected in parallel.

10. The LED selecting circuit of claim 8, wherein the fourth switch is configured to receive a fourth control signal to select the seventh LED group or the eighth LED group.

11. The LED selecting circuit of claim 7, wherein the third switch is configured to receive a third control signal to select the fifth LED group or the sixth LED group.

12. The LED selecting circuit of claim 6, further comprising:

a first resistor connected between an output terminal of the first LED group and the second switch.

13. The LED selecting circuit of claim 12, further comprising:

a second resistor connected between an output terminal of the second LED group and the second switch, and wherein a resistance value of the first resistor is less than a resistance value of the second resistor.

14. The LED selecting circuit of claim 13, wherein the first and second resistors operate as balance resistors.

15. The LED selecting circuit of claim 6, wherein:

the first LED group has a color temperature of about 1500K to about 3000K; and the second LED group has a color temperature of about 4000K to about 7000K.

16. The LED selecting circuit of claim 6, wherein the second switch is configured to receive a second control signal to select the third LED group or the fourth LED group.

* * * * *